US009490542B1

(12) United States Patent
Prinsloo et al.

(10) Patent No.: US 9,490,542 B1
(45) Date of Patent: Nov. 8, 2016

(54) MULTI-MODE COMPOSITE ANTENNA

(71) Applicant: Stellenbosch University, Stellenbosch (ZA)

(72) Inventors: David Schalk Van der Merwe Prinsloo, Somerset-West (ZA); Petrie Meyer, Stellenbosch (ZA); Rob Maaskant, Göteborg (SE); Marianna Valerievna Ivashina, Göteborg (SE)

(73) Assignee: Stellenbosch University, Stellenbosch (ZA)

( * ) Notice: Subject to any disclaimer, the term of this patent is extended or adjusted under 35 U.S.C. 154(b) by 0 days.

(21) Appl. No.: 15/111,066

(22) PCT Filed: Jan. 15, 2015

(86) PCT No.: PCT/IB2015/050300
§ 371 (c)(1),
(2) Date: Jul. 13, 2016

(87) PCT Pub. No.: WO2015/107473
PCT Pub. Date: Jul. 23, 2015

(30) Foreign Application Priority Data

Jan. 17, 2014 (ZA) ..... 2014/00363

(51) Int. Cl.
*H01Q 25/04* (2006.01)
*H01Q 9/26* (2006.01)
(Continued)

(52) U.S. Cl.
CPC ..... *H01Q 9/16* (2013.01); *H01Q 9/28* (2013.01); *H01Q 9/40* (2013.01); *H01Q 21/26* (2013.01)

(58) Field of Classification Search
CPC ..... H01Q 9/26; H01Q 9/28; H01Q 21/205; H01Q 21/24; H01Q 21/26; H01Q 25/04
See application file for complete search history.

(56) References Cited

U.S. PATENT DOCUMENTS 4,647,942 A * 3/1987 Counselman, III .... H01Q 1/125 343/797
8,325,101 B2 * 12/2012 Payne ..... H01Q 1/36 343/792

(Continued)

FOREIGN PATENT DOCUMENTS

WO WO 03/007422 A1 1/2003
WO WO 2013/039570 A1 3/2013
WO WO 2013/109173 A1 7/2013

OTHER PUBLICATIONS

International Preliminary Report on Patentability for International Application No. PCT/IB2015/050300 mailed Jul. 19, 2016.

(Continued)

*Primary Examiner* — Hoang V Nguyen
(74) *Attorney, Agent, or Firm* — Andrus Intellectual Property Law, LLP

(57) ABSTRACT

A multi-mode composite antenna is disclosed. The antenna includes at least two dipole elements, each dipole element having two arms with a signal transmission line connected to each arm, a conductive tube in which the signal transmission lines extend which forms a shield for the signal transmission lines, and an extension of the conductive tube. In one embodiment, the extension is formed by the conductive tube being folded back over itself. The dipole elements are capable of being excited by at least one differential mode excitation to realize a dipole radiation pattern, and the extension forms a monopole element with a monopole radiation pattern when at least one dipole element is excited by a common mode excitation. The composite antenna is capable of a combined monopole and dipole radiation pattern through the application of both differential mode excitation and common mode excitation.

13 Claims, 6 Drawing Sheets

(51) Int. Cl.

| | |
|---|---|
| ***H01Q 9/16*** | (2006.01) |
| ***H01Q 9/28*** | (2006.01) |
| ***H01Q 9/40*** | (2006.01) |
| ***H01Q 21/26*** | (2006.01) |

(56) References Cited

U.S. PATENT DOCUMENTS

| | | | | |
|---|---|---|---|---|
| 8,786,511 | B1 * | 7/2014 | Dao | H01Q 1/08 343/793 |
| 2012/0081259 | A1 * | 4/2012 | Regala | H01Q 21/26 343/797 |

OTHER PUBLICATIONS

Prinsloo D S et al: "Design of an Active Dual-Mode Antenna with near hemispherical Field of View coverage", 2013 International Conference on Electromagnetics in Advanced Applications (ICEAA), IEEE, Sep. 9, 2013 (Sep. 9, 2013), pp. 1064-1067, XP032505038, DOI: 10.1109/ICEAA.2013.6632405.

International Search Report for International Application No. PCT/IB2015/050300 mailed May 18, 2015.

Written Opinion for International Application No. PCT/IB2015/050300 mailed May 18, 2015.

* cited by examiner

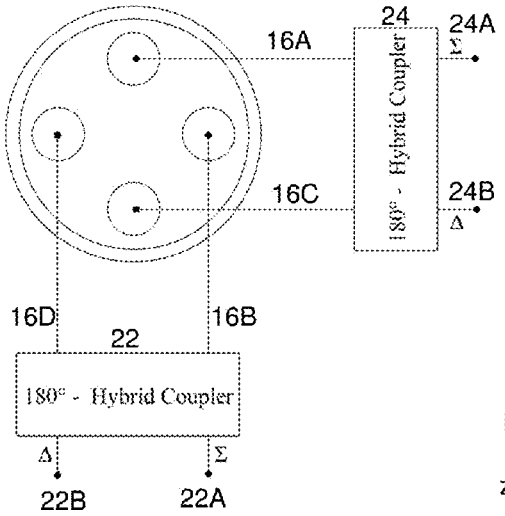
Figure 2
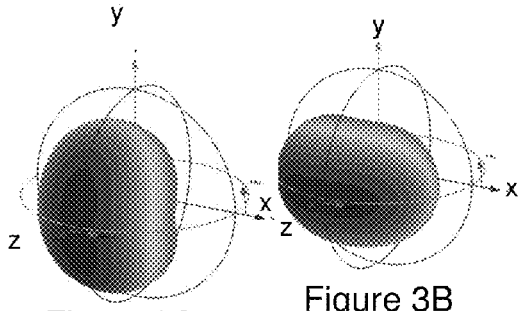
Figure 3A
Figure 3B
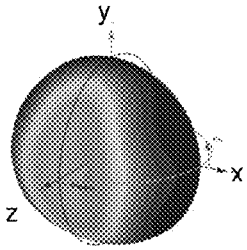
Figure 3C
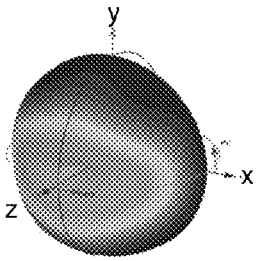
Figure 3D
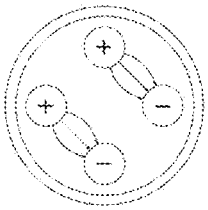
Figure 4A
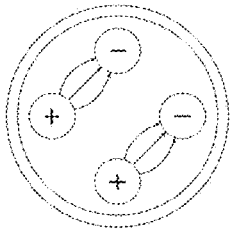
Figure 4B
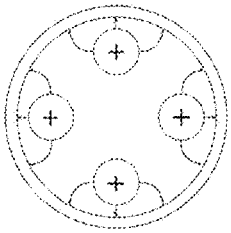
Figure 4C
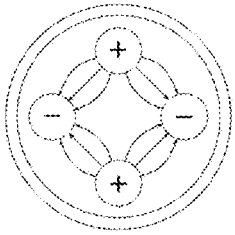
Figure 4D
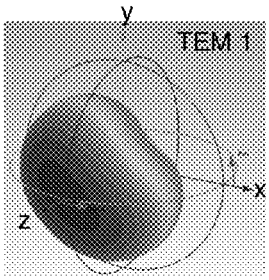
Figure 5A
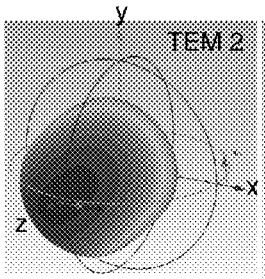
Figure 5B
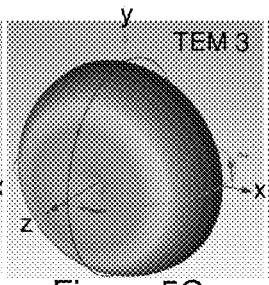
Figure 5C
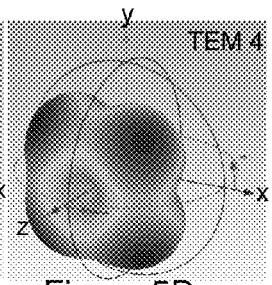
Figure 5D

MULTI-MODE COMPOSITE ANTENNA

CROSS-REFERENCE(S) TO RELATED APPLICATIONS

This application is the U.S. national stage application of International Application PCT/IB2015/050300, filed Jan. 15, 2015, which international application was published on Jul. 23, 2015, as International Publication WO 2015/107473 in the English language. The International Application claims priority of South African Provisional Patent Application 2014/00363, filed Jan. 17, 2014.

FIELD OF THE INVENTION

This invention relates to an antenna and, more specifically, to a multi-mode composite antenna.

BACKGROUND TO THE INVENTION

In many wireless antenna applications it is desirable to receive or transmit signals from a wide variety of possible angles. However, the radiation pattern of an antenna element is never completely omni-directional, as there is always a direction from which an antenna receives less power than its optimal direction. For straight wire antennas, such as monopole or dipole antennas, the radiation pattern is zero in the direction of the wire.

Various attempts have been made to combine monopole and dipole antennas so as to create composite antennas that can transmit or receive from more directions with a more even power distribution. The ideal is generally to create a hemispherical radiation pattern for an antenna over a ground plane. However, the combination of a single monopole and dipole do not produce a radiation pattern that is very hemispherical as there are multiple local minima. In addition, collocation of the monopole and dipole is generally a problem and many previous attempts to combine monopoles and dipoles are sub-optimal because they are not accurately collocated.

WO2013109173A1 discusses a combined monopole and dipole antenna. A dipole antenna has a common-mode rejection filter positioned along a non-shielded portion of the dipole transmission line so as to create an orthogonal monopole element from the non-shielded transmission line. Although this disclosure addresses the collocation problem, the described antenna requires a common-mode rejection filter and the resultant complexities which that entails. The non-shielded transmission line may also result in spurious interference even when driven by differential mode excitation.

The invention aims to address these and other shortcomings, at least to some extent.

The preceding discussion of the background to the invention is intended only to facilitate an understanding of the present invention. It should be appreciated that the discussion is not an acknowledgment or admission that any of the material referred to was part of the common general knowledge in the art as at the priority date of the application.

SUMMARY OF THE INVENTION

In accordance with the invention there is provided a multi-mode composite antenna comprising:

at least two dipole elements, each dipole element having two arms with a signal transmission line connected to each arm, the dipole elements being capable of being excited by at least one differential mode excitation to realize a dipole radiation pattern;

a conductive tube in which the signal transmission lines extend and which forms a shield for the signal transmission lines; and an extension of the conductive tube, the extension forming a monopole element with a monopole radiation pattern when at least one dipole element is excited by a common mode excitation, the composite antenna thereby being capable of a combined monopole and dipole radiation pattern through the application of both differential mode excitation and common mode excitation.

Further features provide for the conductive tube to be a right cylindrical conductive tube and for the monopole element to be formed by an extension of the cylindrical tube which has been folded back over itself.

In one embodiment, the extension of the cylindrical tube is folded back over itself and extends generally parallel to the cylindrical conductive tube, and the dipole arms are cylindrical elements.

In a different embodiment, the extension of the cylindrical tube is folded back over itself and flares outwardly from the cylindrical conductive shield to form a conical section, and the dipole arms are made from sheet material that widens towards a free end thereof to form generally sector-shaped dipole arms.

Further features provide for the length of each arm of each dipole element to be equal to a height of the extension of the conductive tube which forms the monopole element as measured perpendicularly to the dipole element, to thereby ensure that the dipole radiation pattern and monopole radiation pattern occur at the same frequency.

Further features provide for the conductive tube to be connected to a ground plane; and for the two arms of each dipole element to be generally collinear and to extend in opposed directions along a common plane.

Further features provide for the composite antenna to include two dipole elements having arms which extend perpendicularly to each other, the two dipole elements and the monopole element thereby forming three radiating elements that extend in three mutually perpendicular directions.

Further features provide for there to be four signal transmission lines each connected to one of the arms of the two dipole elements, and for the pair of signal transmission lines connected to each dipole element to be coupled to a 180 degree hybrid coupler that has a differential mode and a common mode.

Further features provide for hybrid couplers to simultaneously excite the two dipole elements with four orthogonal transverse electromagnetic excitation modes.

Further features provide for beam-forming weights to be applied to the four orthogonal excitation modes so as to electronically shape the field of view of the composite antenna.

Further features provide for the beam-forming weights to be applied to the four orthogonal excitation modes such that a field of view coverage of the composite antenna approximates a hemispherical field of view.

The invention extends to an antenna array comprising a plurality of multi-mode composite antennas as previously described arranged in a predetermined field configuration.

The invention further extends to a radio telescope comprising an antenna array as previously described in which the direction of scanning can be controlled by electronically shaping the field of view of the composite antennas without the need for the composite antennas to be capable of moving.

BRIEF DESCRIPTION OF THE DRAWINGS

The invention will now be described, by way of example only, with reference to the accompanying representations in which:

FIG. 2 is a schematic illustration showing the connection of two hybrid couplers to the signal transmission lines;

FIGS. 3A to 3D are far-field radiation patterns that result from separate excitation of the dipole elements and the monopole element;

FIGS. 4A to 4D are excitation field distributions for four orthogonal transverse electromagnetic (TEM) excitation modes;

FIGS. 5A to 5D are far-field radiation patterns corresponding to the excitation field distributions of FIGS. 4A to 4D;

DETAILED DESCRIPTION WITH REFERENCE TO THE DRAWINGS

Figure 1A:
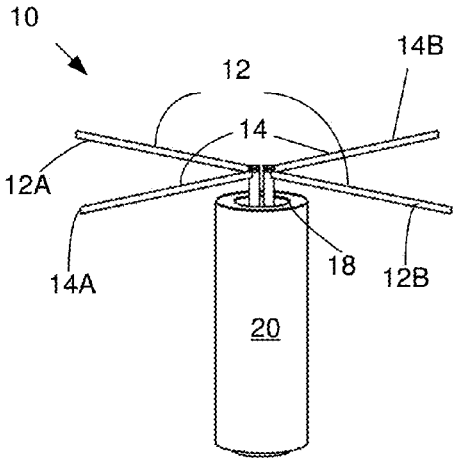
FIG. 1A is a three dimensional view of a multi-mode composite antenna according to a first embodiment of the invention.
Figure 1B:
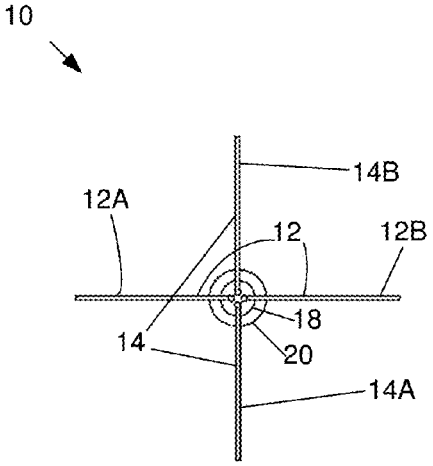
FIG. 1B is a top plan view of the antenna of FIG. 1A.
Figure 1C:
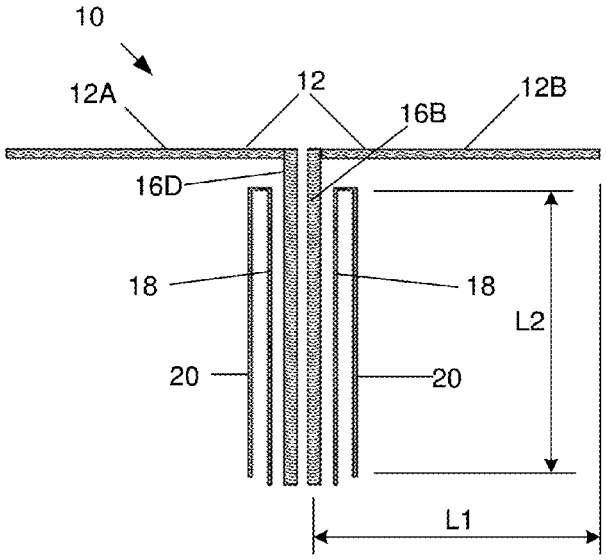
FIG. 1C is a sectional elevation of the antenna of FIG. 1A.

FIGS. 1A to 1C illustrate a multi-mode composite antenna (10) according to a first embodiment of the invention. The antenna (10) includes first and second dipole elements (12, 14) which each have a pair of collinear arms (12A, 12B, 14A, 14B) extending in opposed directions along a common plane. In this embodiment the arms are cylindrical conductive elements and the arms (12A, 12B) of the first dipole element (12) extend perpendicularly to the arms (14A, 14B) of the second dipole element (14).

Figure 1D:
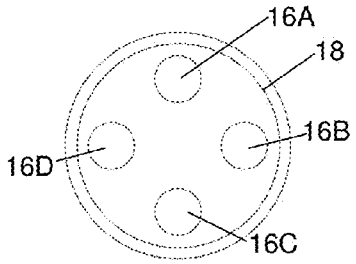
FIG. 1D is a bottom view showing a portion of the antenna of FIG. 1A with its four signal transmission lines.

Each of the dipole arms is connected to a separate signal transmission line (16A, 16B, 16C, 16D), shown most clearly in FIG. 1D. The four signal transmission lines extend within a conductive right cylindrical tube (18) which forms a shield for the signal transmission lines. The cylindrical tube (18) has an extension which has been folded back over itself to form an outer sleeve (20) that extends in parallel with the conductive tube (18), as most clearly seen in FIG. 1C. The conductive tube (18) is connected to a ground plane (not shown). Preferably, as shown in FIG. 1C, the length (L1) of each arm of each dipole element (12) is equal to the height (L2) of the extension of the conductive tube which forms the monopole element as measured perpendicularly to the dipole element, to thereby ensure that the dipole radiation pattern and monopole radiation pattern occur at the same frequency.

As will be explained herein, when the four signal transmission lines (16A, 16B, 16C, 16D) are excited by a differential mode excitation, the two dipole elements (12, 14) realize a dipole-over-ground radiation pattern. When excited by a common mode excitation, the conductive sleeve (20) forms a monopole element with a monopole radiation pattern. Together, the two dipole elements and one monopole element form three mutually perpendicular radiating elements. By applying both differential mode excitation and common mode excitation the multi-mode composite antenna (10) is capable of a combined monopole and dipole radiation pattern, thereby enabling a near hemispherical field-of-view to be achieved.

FIG. 2 is a schematic illustration showing the connection of the four signal transmission lines (16A, 16B, 16C, 16D) to a first and a second 180 degree hybrid coupler (22, 24) by means of which the three perpendicular radiating elements can each be excited individually or in combination. Each hybrid coupler has a sum port (22A, 24A) and a difference port (22B, 24B) and has its two outputs connected to each of the arms of one of the dipole elements by way of the signal transmission lines (16A, 16B, 16C, 16D). The hybrid couplers work as follows: when the sum port (22A, 24A) is excited and the difference port (22B, 24B) is terminated in a matched load, the outputs of a hybrid coupler are in-phase. When the difference port (22B, 24B) is excited and the sum port (22A, 24A) is terminated in a matched load, the outputs are out of phase.

Figure 6A:
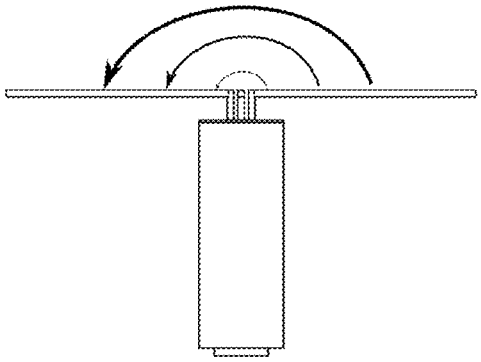
FIG. 6A is a radiated near-field distribution resulting from a differential mode excitation of one of the hybrid couplers.

The two hybrid couplers can be used to separately excite each of the dipole elements and the monopole element. Assume that there are three axes x, y and z where z is perpendicular to a ground plane, and that the first dipole (12) has its two arms (12A, 12B) extending along the x-axis with the first hybrid coupler (22) connected to the signal transmission lines of the first dipole (12). Exciting the difference port (22B) of the first hybrid coupler (22), while keeping the other three ports (22A, 24A, 24B) of the two couplers terminated in their characteristic impedances, excites the two arms (12A, 12B) of the first dipole out of phase resulting in a typical dipole-over-ground radiation pattern as shown in FIG. 3A. The near-field distribution that causes this radiation pattern is shown in FIG. 6A. Similarly, exciting the difference port (24B) of the second hybrid coupler (24), while keeping the other three ports (22A, 22B, 24A) terminated in their characteristic impedances, excites the two arms (14A, 14B) of the second dipole (14) out of phase, resulting in the radiation pattern shown in FIG. 3B.

Figure 6B:
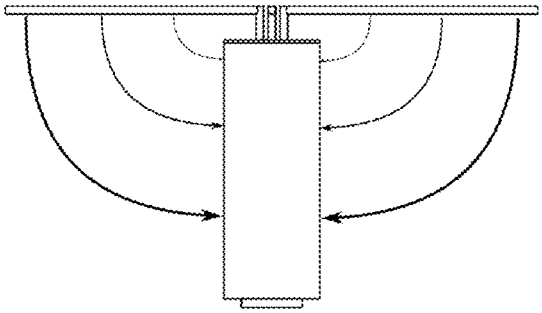
FIG. 6B is a radiated near-field distribution resulting from a common mode excitation of one of the hybrid couplers.

Exciting only the sum port (22A) of the first hybrid coupler (22) excites the two arms (12A, 12B) of the first dipole (12) in-phase, resulting in the near-field distribution shown in FIG. 6B and the far-field radiation pattern shown in FIG. 3C, which is a monopole radiation pattern. And similarly, exciting only the sum port (24A) of the second hybrid coupler (24) excites the two arms (14A, 14B) of the second dipole (14) in-phase, resulting in the monopole radiation pattern shown in FIG. 3D.

Figure 7:
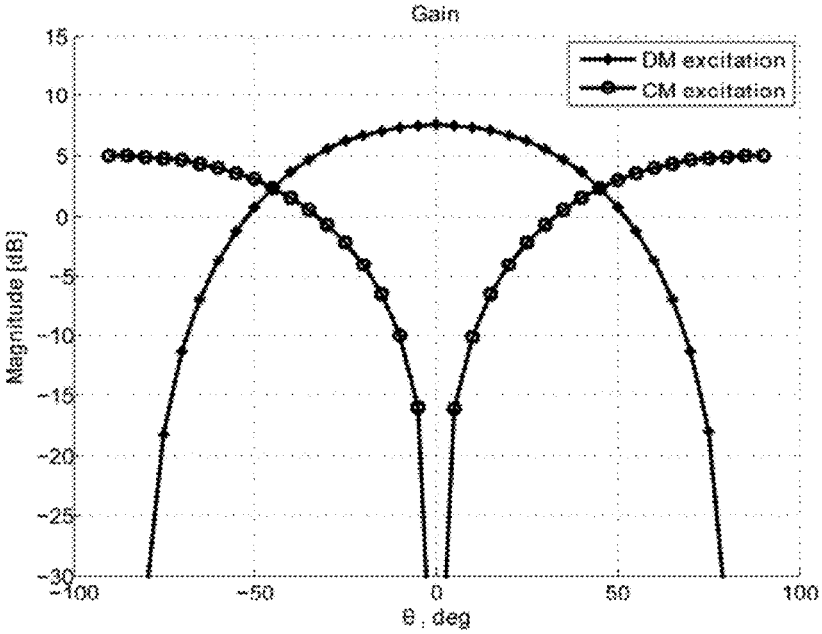
FIG. 7 is a graph showing the far-field distribution over a 180 degree angle for common mode excitation and differential mode excitation.

It will therefore be appreciated that by individually exciting one of the four ports of the two hybrid couplers, four different radiation patterns shown in FIGS. 3A to 3D can be produced, two of which are a dipole-over-ground radiation pattern and two a monopole radiation pattern. FIG. 7 shows a graph of the dipole and monopole radiation patterns of 3A and 3C plotted along an angle between the x and z axes.

In some applications it is desirable to excite all four signal transmission lines simultaneously, rather than individually. By using four orthogonal transverse electromagnetic (TEM) excitation modes and combining them linearly, the same radiation patterns as indicated in FIGS. 3A to 3D can be realized. The four orthogonal TEM excitation modes required to achieve this are shown as TEM1 to TEM4 in FIGS. 4A to 4D respectively. Each of the radiation patterns shown in FIG. 3A to 3D can be realized as linear combinations of the four orthogonal TEM excitation modes TEM1 to TEM4 as follows:

Excitation pattern of FIG. 3A=TEM1+TEM2
Excitation pattern of FIG. 3B=TEM1−TEM2
Excitation pattern of FIG. 3C=TEM3−TEM4
Excitation pattern of FIG. 3D=TEM3+TEM4

Where:

- TEM1 is produced by simultaneously exciting the difference ports of both hybrid couplers in phase, while the sum ports are terminated in a matched load;
- TEM2 is produced by exciting the difference ports of both hybrid couplers out of phase, while the sum ports are terminated in a matched load;
- TEM3 is produced by exciting the sum ports of both hybrid couplers in phase, with the difference ports terminated in a matched load; and
- TEM4 is produced by exciting the sum ports of both hybrid couplers out of phase, with the difference ports terminated in a matched load.

Figure 8:
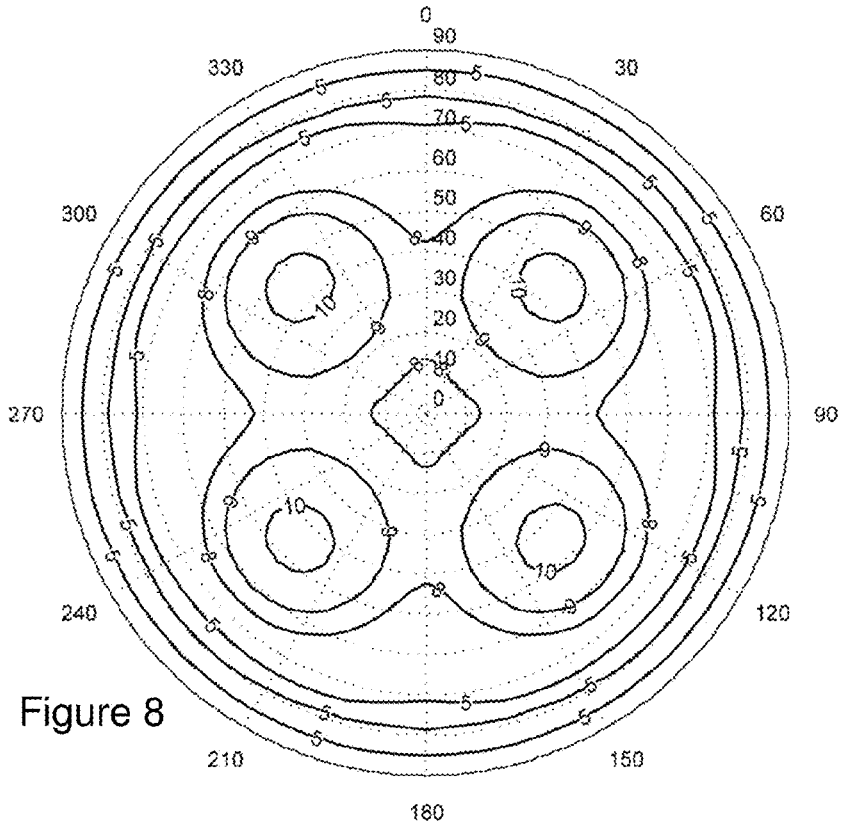
FIG. 8 is a diagram showing the gain of the composite antenna over a hemispherical field of view when beamforming for maximum gain at each scan angle of the hemispherical field of view.
Figure 9:
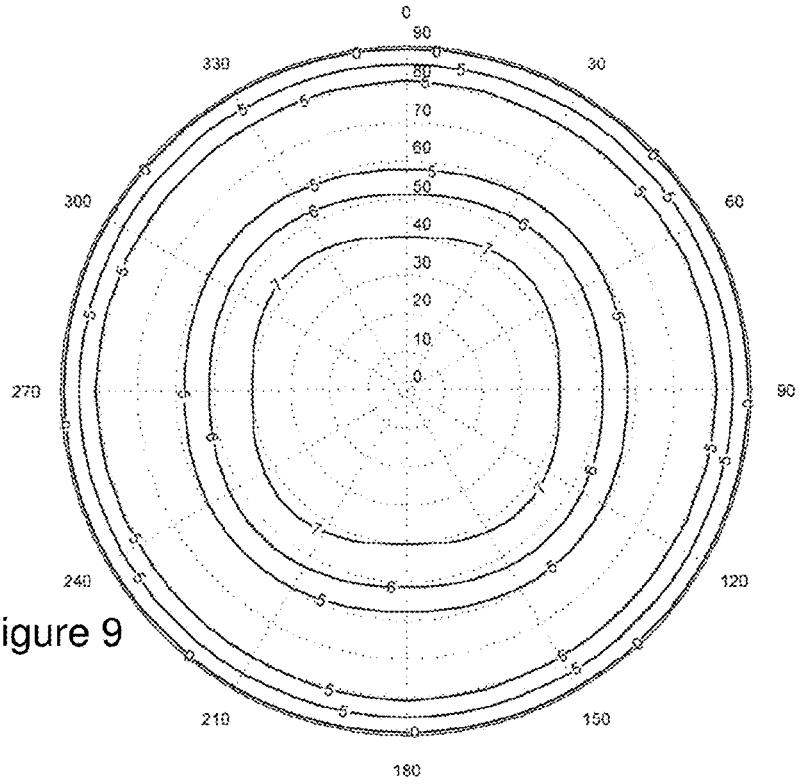
FIG. 9 is a diagram showing the gain of the composite antenna over a hemispherical field of view when beamforming to ensure near-axisymmetric gain over the hemispherical field of view.

By applying complex beam-forming weights to the four orthogonal excitation modes (TEM1 to TEM4), the field of view of the composite antenna can be shaped. FIG. 8 is a diagram showing the gain of the composite antenna over a hemispherical field of view when beam-forming for maximum gain at each scan angle of the hemispherical field of view. FIG. 9 is a diagram showing the gain of the composite antenna over a hemispherical field of view when beam-forming to ensure near-axisymmetric gain over the hemispherical field of view.

Due to the orthogonal nature of the four transverse excitation modes, the antenna can be used as a single element scanning antenna by beam-forming each excitation mode. In the presence of a ground plane, near hemispherical field of view coverage can be obtained by applying complex beam-forming weights to each excitation mode.

The composite antenna can be integrated in micro base transceiver stations (BTS) for wireless communication networks, or as a 4-port multiple-input and multiple-output (MIMO) antenna, both in line-of-sight and rich isotropic multipath (RIMP) environments. The antenna can be mounted on walls while still being able to intercept signals from various directions and polarizations which may be due to multipath effects, so as to maintain high data throughput rates. The antenna diversity achieved by the multiple orthogonal excitation modes allows for the use of a single multi-mode antenna in multipath MIMO applications.

The configuration of the composite antenna allows for a more symmetrical design when compared to existing antenna designs such as printed substrate antenna designs. The antenna of the invention displays improvement in the polarimetric performance of the antenna as compared to dual-polarised antennas.

Figure 10A:
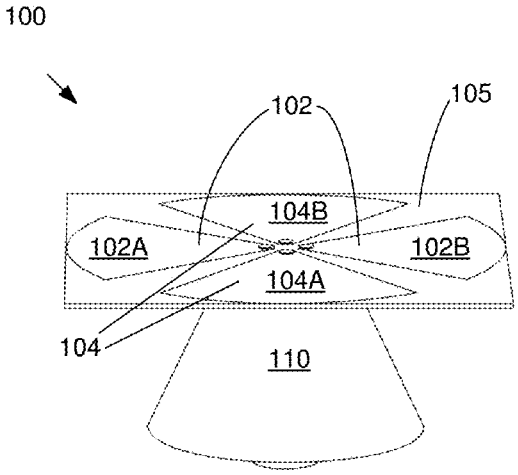
FIG. 10A is a three dimensional view of a multi-mode composite antenna according to a second embodiment of the invention.
Figure 10B:
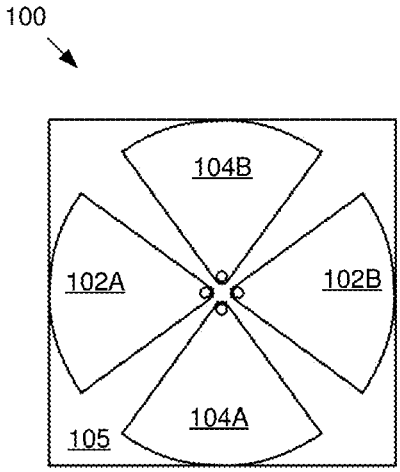
FIG. 10B is a top plan view of the antenna of FIG. 10A.
Figure 10C:
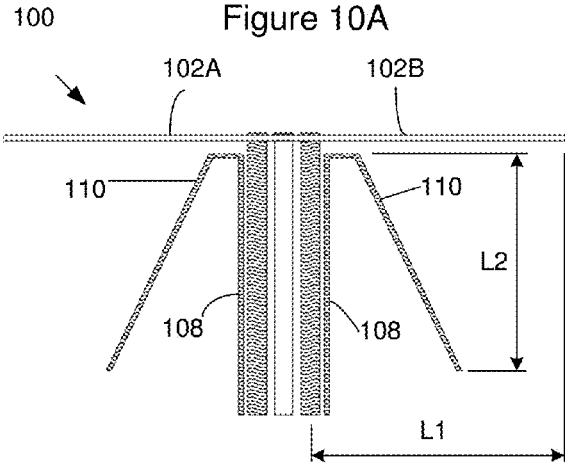
FIG. 10C is a sectional elevation of the antenna of FIG. 10A.

FIGS. 10A to 10C show a multi-mode composite antenna (100) according to a second embodiment of the invention, which has improved operating bandwidth as compared to the antenna (10) of FIGS. 1A to 10. The composite antenna (100) includes first and second dipole elements (102, 104), which each have a pair of collinear arms (102A, 102B, 104A, 104B) extending in opposed directions along a common plane. In this embodiment each arm is made from sheet material which widens towards free ends thereof to form generally sector-shaped dipole arms. The sector-shaped dipole arms can be made as solid metal plates or, in the illustrated embodiment, can be printed on a substrate (105). The arms (102A, 102B) of the first dipole element (102) extend perpendicularly to the arms (104A, 104B) of the second dipole element (104). As shown in FIG. 10C, the length (L1) of each arm of each dipole element (102) is equal to the height (L2) of the extension of the conductive tube which forms the monopole element, as measured perpendicularly to the dipole element, to thereby ensure that the dipole radiation pattern and monopole radiation pattern occur at the same frequency.

Figure 10D:
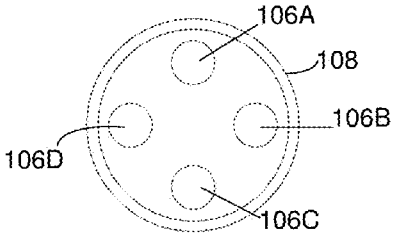
FIG. 10D is a bottom view showing a portion of the antenna of FIG. 10A with four signal transmission lines.

Each of the dipole arms is connected to a separate signal transmission line (106A, 106B, 106C, 106D) shown most clearly in FIG. 10D. The four signal transmission lines extend within a conductive right cylindrical tube (108) which forms a shield for the signal transmission lines. The cylindrical tube (108) has an extension which has been folded back over itself to form an outer sleeve (110). In this embodiment, the outer sleeve (110) flares outwardly from the cylindrical tube (108) to form a conical section, shown in FIG. 10C.

Figure 11A:
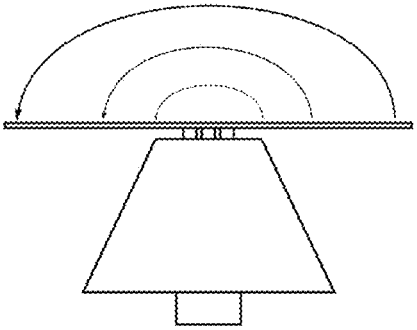
FIG. 11A is a radiated near-field distribution of the antenna of FIG. 10A resulting from a differential mode excitation.
Figure 11B:
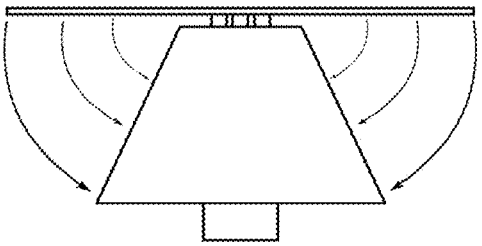
FIG. 11B is a radiated near-field distribution of the antenna of FIG. 10A resulting from a common mode excitation.

As in the embodiment of FIGS. 1A to 10, the dipole elements (102, 104) and the monopole sleeve (110) of the multi-mode composite antenna (100) can be excited individually using the four signal transmission lines (106A, 106B, 106C, 106D). The near-field distribution that results from differential mode excitation of at least one of the dipole elements is illustrated in FIG. 11A, and the near-field distribution that results from common mode excitation of at least one of the dipole elements, so as to form a monopole radiation pattern, is illustrated in FIG. 11B. By applying the same four orthogonal TEM modes, a broad-band near-hemispherical field of view can be obtained.

The two multi-mode composite antennas thus far described can be made in different sizes and configurations for different applications. Table 1 below illustrates four exemplary applications for a multi-mode composite antenna, together with an illustrative width of each antenna (i.e. the combined length of the two arms of the dipole elements) and height of the antenna as measured perpendicularly to the dipole element. It also shows the approximate bandwidth of the antenna and which of the two illustrated embodiments are recommended for the application. The acronyms under the heading "Application" are well known to those in the field of wireless telecommunication. GSM stands for Global System for Mobile Communication and is a cellular telephone technology. UMTS is Universal Mobile Telecommunications System, WCDMA is Wideband Code Division Multiple Access and LTE is Long Term Evolution. Of course, numerous other applications exist and the invention is not limited to any of these applications.

TABLE 1

Approximate Dimensions of a Multi-Mode Composite Antenna for Various Applications

| Application | Antenna Height (mm) | Antenna Width (mm) | Approximate Bandwidth | Recommended Antenna Design |
|---|---|---|---|---|
| GSM1800/1900, UMTS/3G, WCDMA | 39 | 78 | 25% | Conical design of FIG. 10A |
| LTE1800, LTE2300 | 36 | 72 | 35% | Conical design of FIG.10A |
| WiFi (2.4 GHz) | 31 | 62 | <10% | Cylindrical design of FIG. 1A |
| WiFi (5.8 GHz) | 13 | 26 | <10% | Cylindrical design of FIG. 1A |

Figure 12:
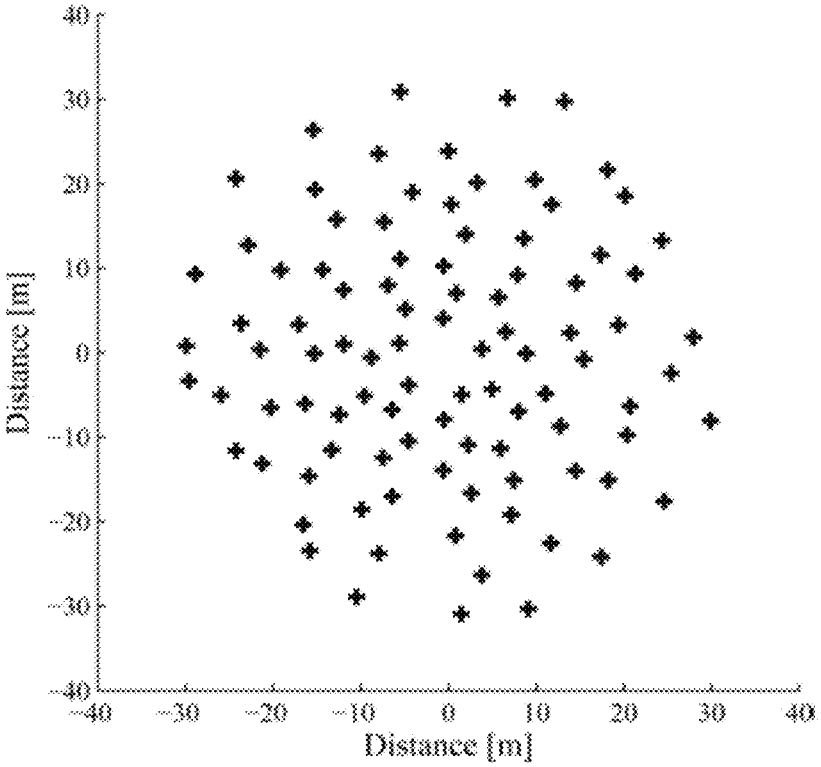
FIG. 12 is an exemplary field configuration layout of an array of multi-mode composite antennas according to the invention.
Figure 13:
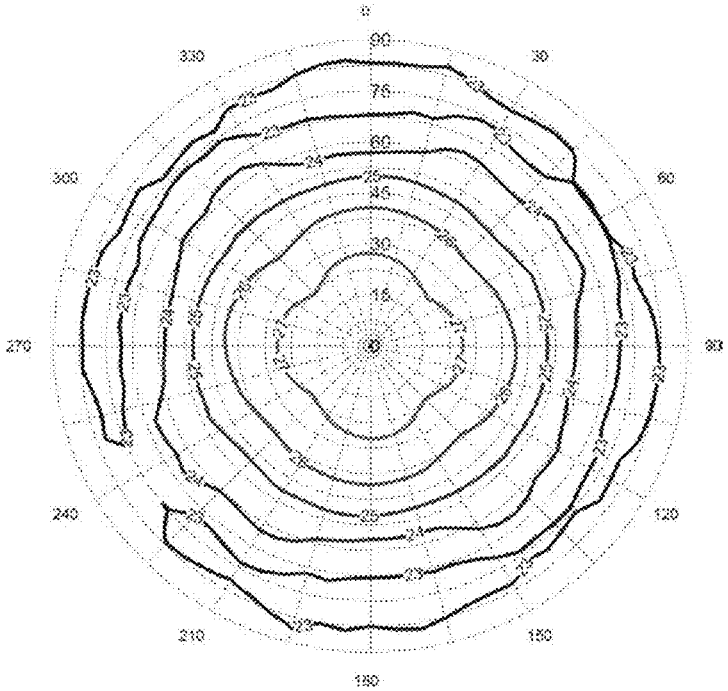
FIG. 13 is a diagram showing the gain of the multi-mode composite antenna array of FIG. 12 over a hemispherical field of view when beamforming to ensure near-axisymmetric gain over the hemispherical field of view.

While the multi-mode composite antenna of either of the embodiments described can be used as a single antenna it can also be arranged into an antenna array which includes a plurality of antennas arranged in a predetermined field configuration. FIG. 12 shows an exemplary field configuration for an array of multi-mode composite antennas. The illustrated field configuration is based on a 96 element array and is arranged in an irregular configuration. The configuration is based on an existing demonstrator phased antenna array radio telescope known as LOFAR (Low Frequency Array) and is chosen to enable comparison of an antenna array of the invention with existing antennas which are purely differential, i.e. dipole based. The field configuration of FIG. 12 is designed to observe at VHF (Very High Frequency) bands. In this illustration, the size of the antennas are scaled to achieve a resonant frequency of 55 MHz, which requires an antenna height of approximately 1.3 m and width (i.e. the length of two antenna arms) of about 2.6 m. By applying complex beam-forming weights to the four orthogonal excitation modes (TEM1 to TEM4) as previously described, the gain of the antenna array can be maximised at each scan angle. FIG. 13 is a diagram showing the gain of the multi-mode composite antenna array of FIG. 12 over a hemispherical field of view when beamforming to ensure near-axisymmetric gain over the hemispherical field of view. The array configuration realises a near-axisymmetric gain pattern which varies by less than 5 dB over the hemispherical field-of-view coverage. This is an improvement in the field of view coverage as compared to existing antenna arrays. Mutual coupling between the four fundamental excitation modes of the individual antennas was found to be very low, below −15 dB for all excitation modes.

The antenna array could find particular application in radio astronomy applications. In such applications, the antenna array is used as a radio telescope where scanning all the way down to the horizon in specific directions can be done by electronically shaping the field of view of the composite antennas without the need for the antennas to be capable of physically moving and tracking a target.

The invention is not limited to the described embodiments and numerous modifications are included within the scope of the invention. For example, the composite antenna does not need to have only two dipole elements but could include three, four or any higher number of dipole elements. The extension of the conductive tube does not need to be formed by folding the tube back on itself but could be any other kind of extension which, when the dipole elements are excited by a common mode excitation, results in a monopole radiation pattern. Numerous choices exist for the material of construction and the means for exciting the dipole elements.

Throughout the specification and claims unless the contents requires otherwise the word 'comprise' or variations such as 'comprises' or 'comprising' will be understood to imply the inclusion of a stated integer or group of integers but not the exclusion of any other integer or group of integers.

The invention claimed is:

1. A multi-mode composite antenna comprising:

at least two dipole elements, each dipole element having two arms with a signal transmission line connected to each arm, the dipole elements being capable of being excited by at least one differential mode excitation to realize a dipole radiation pattern;

a conductive tube in which the signal transmission lines extend and which forms a shield for the signal transmission lines; and an extension of the conductive tube, the extension forming a monopole element with a monopole radiation pattern when at least one dipole element is excited by a common mode excitation, the composite antenna thereby being capable of a combined monopole and dipole radiation pattern through the application of both differential mode excitation and common mode excitation.

2. A multi-mode composite antenna as claimed in claim 1 in which the conductive tube is a right cylindrical conductive tube and the monopole element is formed by an extension of the cylindrical tube which has been folded back over itself.

3. A multi-mode composite antenna as claimed in claim 2 in which the extension of the cylindrical tube is folded back over itself and extends generally parallel to the cylindrical conductive tube, and the dipole arms are cylindrical elements.

4. A multi-mode composite antenna as claimed in claim 2 in which the extension of the cylindrical tube is folded back over itself and flares outwardly from the cylindrical conductive shield to form a conical section, and each dipole arm is made from sheet material that widens towards a free end thereof to form generally sector-shaped dipole arms.

5. A multi-mode composite antenna as claimed in claim 1 in which the length of each arm of each dipole element is equal to a height of the extension of the conductive tube which forms the monopole element as measured perpendicularly to the dipole element, to thereby ensure that the dipole radiation pattern and monopole radiation pattern occur at the same frequency.

6. A multi-mode composite antenna as claimed in claim 1 in which the conductive tube is connected to a ground plane and the two arms of each dipole element are generally collinear and extend in opposed directions along a common plane.

7. A multi-mode composite antenna as claimed in claim 1 in which the composite antenna includes two dipole elements having arms which extend perpendicularly to each other, the two dipole elements and the monopole element forming three radiating elements that extend in three mutually perpendicular directions.

8. A multi-mode composite antenna as claimed in claim 7 in which there are four signal transmission lines each connected to one of the arms of the two dipole elements, and for the pair of signal transmission lines connected to each dipole element to be coupled to a 180 degree hybrid coupler that has a differential mode and a common mode.

9. A multi-mode composite antenna as claimed in claim 8 in which the 180 degree hybrid couplers simultaneously excite the two dipole elements with four orthogonal transverse electromagnetic excitation modes.

10. A multi-mode composite antenna as claimed in claim 9 in which beam-forming weights are applied to the four orthogonal excitation modes so as to electronically shape the field of view of the composite antenna.

11. A multi-mode composite antenna as claimed in claim 10 in which the beam-forming weights are applied to the four orthogonal excitation modes such that a field of view coverage of the composite antenna approximates a hemispherical field of view.

12. An antenna array comprising a plurality of multi-mode composite antennas as claimed in claim 1 arranged in a predetermined field configuration.

13. A radio telescope comprising an antenna array as claimed in claim 12 in which the direction of scanning can be controlled by electronically shaping the field of view of the composite antennas without the need for the composite antennas to be capable of moving.

* * * * *